US006031456A

United States Patent [19]

Hanyuda

[11] Patent Number: 6,031,456

[45] Date of Patent: Feb. 29, 2000

[54] DETECTOR

[75] Inventor: Kenji Hanyuda, Kanagawa, Japan

[73] Assignee: Nippon Aleph Corporation, Japan

[21] Appl. No.: 09/076,733

[22] Filed: May 13, 1998

[51] Int. Cl.[7] ..... G08B 13/181

[52] U.S. Cl. ..... 340/555; 250/221; 250/DIG. 1; 340/506; 340/556; 340/567; 340/693.5

[58] Field of Search ..... 340/555, 556, 340/567, 506, 693.5; 250/221, DIG. 1

[56] References Cited

U.S. PATENT DOCUMENTS

| | | | |
|---|---|---|---|
| 4,242,669 | 12/1980 | Crick | 340/567 |
| 4,752,768 | 6/1988 | Steers et al. | 340/567 |
| 4,982,094 | 1/1991 | Matsuda | 250/342 |
| 5,091,648 | 2/1992 | Owers et al. | 340/567 |
| 5,243,326 | 9/1993 | Disabato | 340/555 |
| 5,489,892 | 2/1996 | Imuro et al. | 340/567 |
| 5,499,016 | 3/1996 | Pantus | 340/555 |

FOREIGN PATENT DOCUMENTS

0817148 A1 1/1998 European Pat. Off. .

*Primary Examiner*—Glen Swann
*Attorney, Agent, or Firm*—Sterne Kessler Goldstein & Fox P.L.L.C.

[57] ABSTRACT

A detector that can detect an obstacle in a detection field with simple configuration and at low cost is provided. In the detector 10 having a base 11 to be mounted on a ceiling, a wall, or the like, a sensor section 12 which is mounted on the surface of the base, and a cover which is mounted on the base so as to cover the sensor section, the detector 10 is configured such that a obstacle detection sensor 20 for detecting a change of reflectance on and around the surface of the cover can be provided outside the cover 13. The obstacle detection sensor 20 includes light emitting elements 25 and 26 for emitting light to locations on and around the surfaces of the cover, and a light receiving element 24 for receiving reflected light from those locations.

10 Claims, 8 Drawing Sheets

H TRIGGER LEVEL SETTING CIRCUIT

L TRIGGER LEVEL SETTING CIRCUIT

PRIOR ART

DETECTOR

BACKGROUND OF THE INVENTION

1. Field of The Invention

The present invention relates to a detector which, for example, detects changes of incident light to a light receiving element for detecting a trespasser or the like in a specified detection area.

2. Description of The Related Art

Such a detector for crime prevention in prior art has a configuration shown in FIG. 10, for example. In FIG. 10, a detector 1 comprises a base 2, which is mounted on a ceiling, a wall or the like, a sensor section 3, which is mounted on a surface (bottom face) of the base 2, and a cover 4, which is mounted on the base 2 so as to cover the sensor section 3.

The sensor section 3, which is used as a passive sensor, for example, comprised of a pyroelectric element 3*c* for detecting quantity of energy of far infrared radiation from an object, detects changes of quantity of energy of far infrared radiation generated by movement of an individual who trespassed into a detection field 5, and a trespasser can be detected based on this change.

In the case of detector 1 having such a configuration, if an obstacle which disables the detection field 5 is intentionally added, such as placing an interfering cover which completely covers the cover 4, attaching a tape to the external surface of the cover 4, and coating the surface with paint, then the detection field 5 is blocked, disabling the detector 1 to detect a trespasser. To prevent this, in prior art, an obstacle detection section 6 is created near the detection field 5 (or inside the detector 1), an infrared light emitting element 3*a* emits light at every specified time, and the detection signals from an infrared light receiving element 3*b* are monitored.

Because of this structure, when the cover 4 is covered, a tape is attached to the external surface of the cover 4, or paint is coated on the surface, for example, in the detection field 5, detection signals from the infrared light receiving element 3*b* change. Thus the obstacle detection section 6 detects the above mentioned obstacles based on the change of reflected light quantity of infrared radiation from the infrared light emitting element 3*a*.

Such an obstacle detection method by the obstacle detection section 6, however, detects an obstacle outside the cover 4 from inside the cover 4. As a consequence, change of reflected light quantity of infrared radiation caused by an obstacle is small, and to detect this change of reflected light quantity, the obstacle detection section 6 must have a complicated circuit configuration which is of high cost.

There is another detector where a light receiving element is inside the cover and a light emitting element is outside the cover, near the detector main unit, so that an obstacle is detected when the obstacle blocks the direct optical path from the light emitting element to the light receiving element, but this method requires modification of the detector, therefore if the detector has already been installed, the detector must be replaced, and a detection area of a new detector must be readjusted after installation.

There is another detector in prior art, which was disclosed in U.S. Pat. No. 5,499,016, but the problem of this detector is that the detection field of the obstacle detection sensor is limited because the detector main unit is integrated with the obstacle detection sensor.

SUMMARY OF THE INVENTION

It is, accordingly, an object of the present invention to provide a detector which can detect an obstacle in a detection field with a simple configuration and at low cost.

To accomplish this object, the present invention provides a detector comprising: a base for mounting the detector on a ceiling, a wall, or the like; a sensor section which is mounted on the surface of the base; and a cover which is mounted on the base so as to cover the sensor section, and has an obstacle detection sensor outside the cover for detecting a change of reflectance on and around the surface of the cover.

In the detector in accordance with the present invention, preferably the obstacle detection sensor includes a light emitting element for emitting light to locations on and around the surface of the cover, and a light receiving element for receiving reflected light from those locations.

In the detector in accordance with the present invention, preferably the obstacle detection sensor includes two light emitting elements and one light receiving element, which are arranged in the sequence of the first light emitting element, the light receiving element, and the second light emitting element.

In the detector in accordance with the present invention, preferably the obstacle detection sensor also has a particular detection area which intersects the detection area of the sensor section.

According to the above configuration, the obstacle detection sensor for detecting change of reflectance on and around the surface of the cover is located outside the cover, therefore if an attempt is made to disable the detection field of the detector intentionally, such as putting an interfering cover on the cover, attaching a tape to the external surface of the cover, and coating or spraying paint, then the obstacle detection sensor detects the obstacle by detecting change of reflectance caused by the interfering cover, tape or paint, or by detecting change of reflectance caused by a human hand handling the interfering cover, tape or paint.

As a consequence, the detector can accurately detect a trespasser or the like without being interrupted by the interfering cover.

If the object detection sensor includes the light emitting element for emitting light to locations on and around the surface of the cover and a light receiving element for receiving reflected lights from these locations, then the light emitted from the light emitting element is irradiated to areas on and around the surface of the cover and the light receiving element receives light reflected from an obstacle in these areas.

If the obstacle detection sensor includes two light emitting elements and one light receiving element, which are arranged in the sequence of the first light emitting element, the light receiving element and the second light emitting element, then the light emitting elements on both sides irradiate lights in different directions and reflected lights of these lights are received by the light receiving element at the center, therefore an obstacle can be detected in a wide detection area.

If the obstacle detection sensor additionally includes the particular detection area that intersects the detection area of the sensor section, then the detection area of the detector can intersect the particular detection area of the obstacle detection sensor, therefore an obstacle near the detector can be detected and detection accuracy improves.

If the obstacle detection sensor includes two light emitting elements and one light receiving element, which are arranged in the sequence of the first light emitting element for irradiating light to areas on and around the surface of the cover, the light receiving element and the second light receiving element for irradiating light to the particular detection area of the obstacle detection sensor, then the obstacle detection area on and around the surface of the cover and the particular detection area for detecting a trespasser can be easily configured.

The obstacle detection sensor can be configured so as to be a separate unit which is detachable from the detector main unit. With this configuration, the obstacle detection sensor of the present invention can be mounted to a detector which has already been installed. Also with this configuration, a spacer or the like can be installed between the detector main unit and the obstacle detection sensor which allows setting the detection field more freely than the configuration where the detector main unit and the obstacle detection sensor are integrated. It is also easy to make the detection field of the obstacle detection sensor variable.

The obstacle detection sensor can comprise: a light emitting unit; a light receiving unit which receives light emitted from the light emitting unit and outputs a signal based on the quantity of the received light; the first threshold output circuit for outputting the first threshold based on the output signal from the light receiving unit; the second threshold output circuit for outputting the second threshold based on the output signal; and a comparison circuit for outputting a specified signal based on the output signals from the first and second threshold output circuits.

The first and second threshold output circuits can automatically set the threshold levels based on the output signal from the light receiving unit, and output the setting to the comparison circuit.

The above threshold levels can be set when a specified delay time has passed after the output of the signal from the light receiving unit.

The present invention also provides a detector comprising: a based which is mounted on a ceiling, a wall or the like; a sensor section which is mounted on the surface of the base; and a cover which is mounted on the base so as to cover the sensor section, and has an obstacle detection sensor outside the cover for detecting changes of reflectance on and around the surface of the base.

This configuration makes detection by the obstacle detection sensor easy without affecting the detection sensitivity of the detector.

This obstacle detection sensor, too, can be configured so as to be a separate unit which is detachable from the detector main unit.

DESCRIPTION OF THE PREFERRED EMBODIMENTS

The present invention will now be described in detail referring to the accompanying drawings wherein preferred embodiments are shown.

Figure 1:
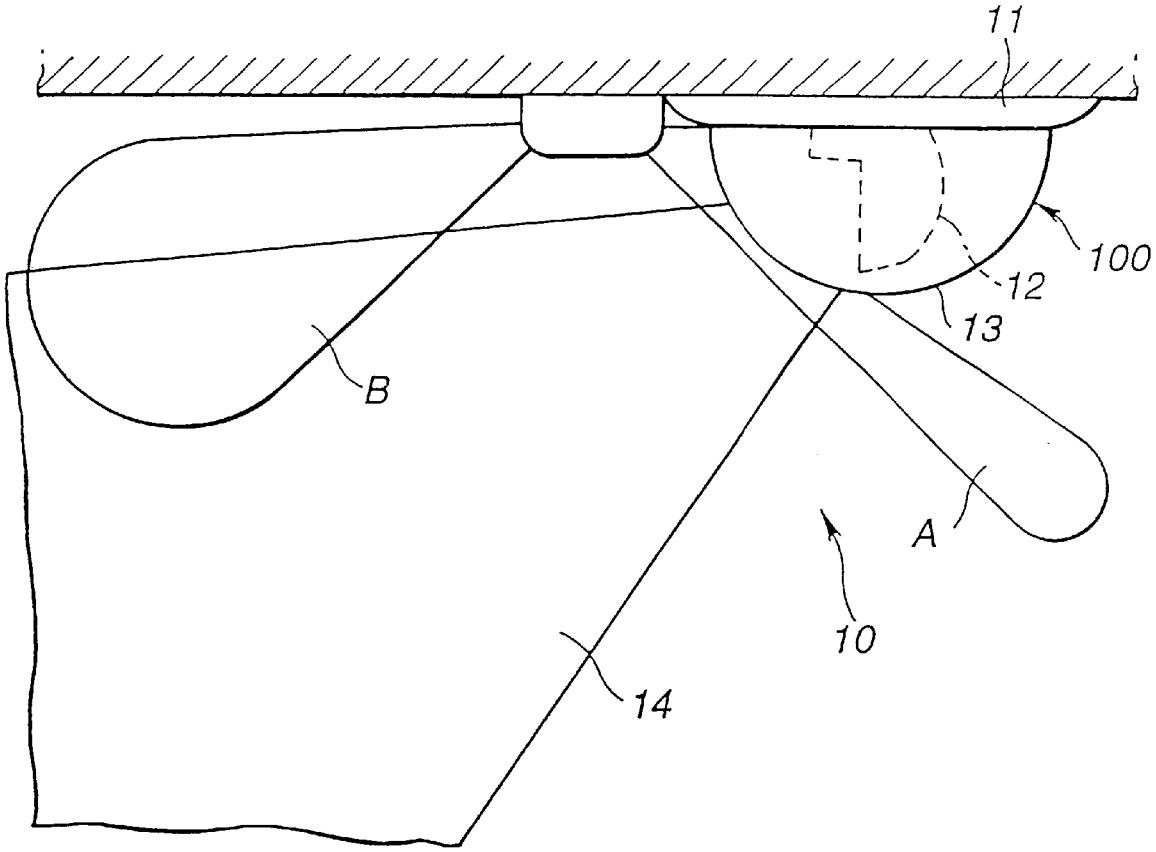
FIG. 1 is a schematic side view depicting a detector of a preferred embodiment of the present invention.
Figure 2:
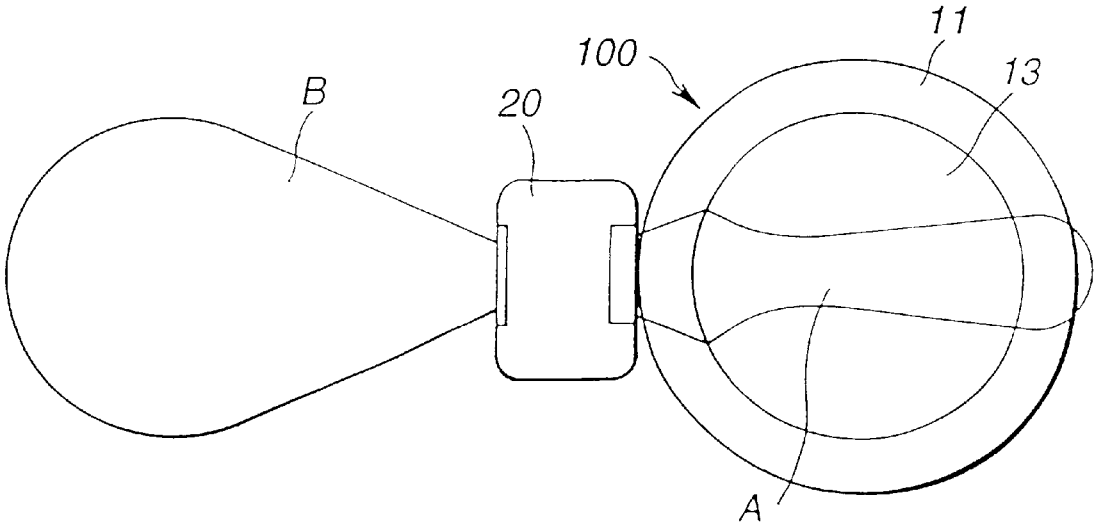
FIG. 2 is a schematic plan view depicting the detector in FIG. 1.

FIG. 1 shows a preferred embodiment of a detector in accordance with the present invention, and a detector 10 comprises a base 11 which is mounted on a ceiling, a wall, or the like, a sensor section 12 which is mounted on the surface (bottom face) of the base 11, and a cover 13 which is mounted on the base 11 so as to cover the sensor section 12.

The sensor section 12, which is used as a passive sensor, for example, and is comprised of a pyroelectric element for detecting quantity of energy of far infrared radiation emitted from an object, detects changes of quantity of energy of the far infrared radiation generated by movement of an individual who transpassed into the detection field 14, and a trespasser can be detected based on this change.

The cover 13, which is created in a hemispherical shape in this illustration, is made from a material that can transmit infrared radiation, and is fixed to the base 11 by means of fixing which is not illustrated here.

This configuration is almost the same as a conventional detector, but in the detector 10 of the preferred embodiment of the present invention, an obstacle detection sensor 20 is equipped outside the cover 13. In the present preferred embodiment, this configuration is referred to as the detector main unit 100.

This obstacle detection sensor 20 is detachable from the detector main unit 100, and has the first detection area A for detecting reflectance on and around the surface of the cover 13 of the detector 10, and the second detection area for intersecting the detection field 14 of the detector 10.

Figure 3:
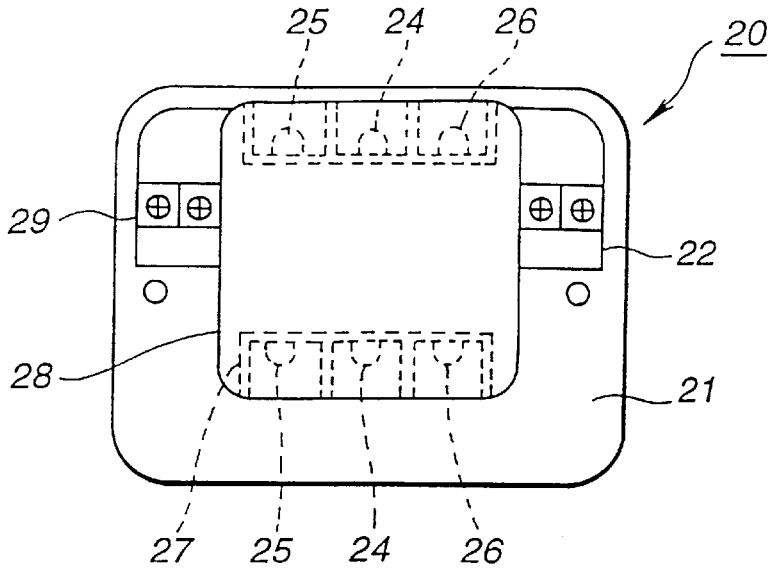
FIG. 3 is a plan view depicting the detector in FIG. 1 when the cover of the obstacle detection sensor is removed.
Figure 4:
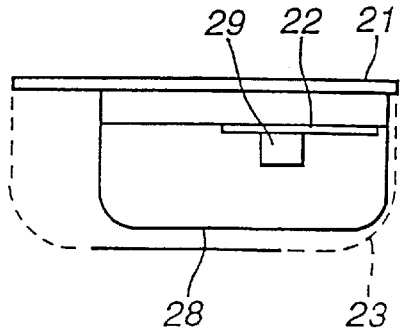
FIG. 4 is a side view of the obstacle detection sensor in FIG. 3.
Figure 5:
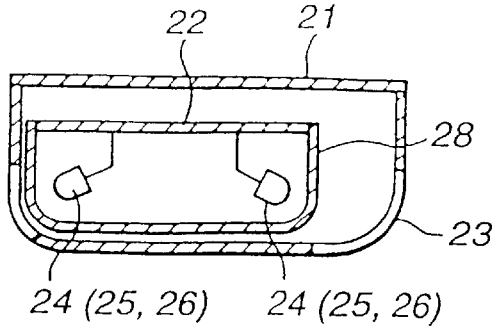
FIG. 5 is a sectional view of the obstacle detection sensor in FIG. 3.

FIG. 3 to FIG. 5 show the configuration of the obstacle detection sensor 20.

In FIG. 3 to FIG. 5, the obstacle detection sensor 20 includes the base 21 which is mounted on a ceiling, a wall, or the like, a board 22 which is mounted on a surface (bottom face) of the base 21, and a cover 23 which is mounted on the base 21 so as to cover the board 22.

On the board 22, a light receiving element 24 is at the center, and the light emitting elements 25 and 26 are on each side respectively, arranged all in parallel to the top and bottom edges. A light shielding plate 27 for preventing wraparound of light is at each location between the light receiving element 24 and the light emitting element 25, and the light receiving element 24 and the light emitting element 26. To block disturbance light, the light receiving element 24 and the light emitting elements 25 and 26 are covered with the board case 28, the entire part of which is made of a visible light cutting filter, for example.

A terminal block 29 for supplying power to the obstacle detection sensor 20 and for outputting detection signals from a detection circuit, which is described later, is created on both ends of the board 22.

The light receiving element 24 and the light emitting elements 25 and 26 do not have such an optical system as a lens, but the optical system can be implemented by a light receiving element and light emitting elements that have a lens with narrow directional characteristics, since 50 cm is sufficient for distance of the detection areas A and B.

Figure 6:
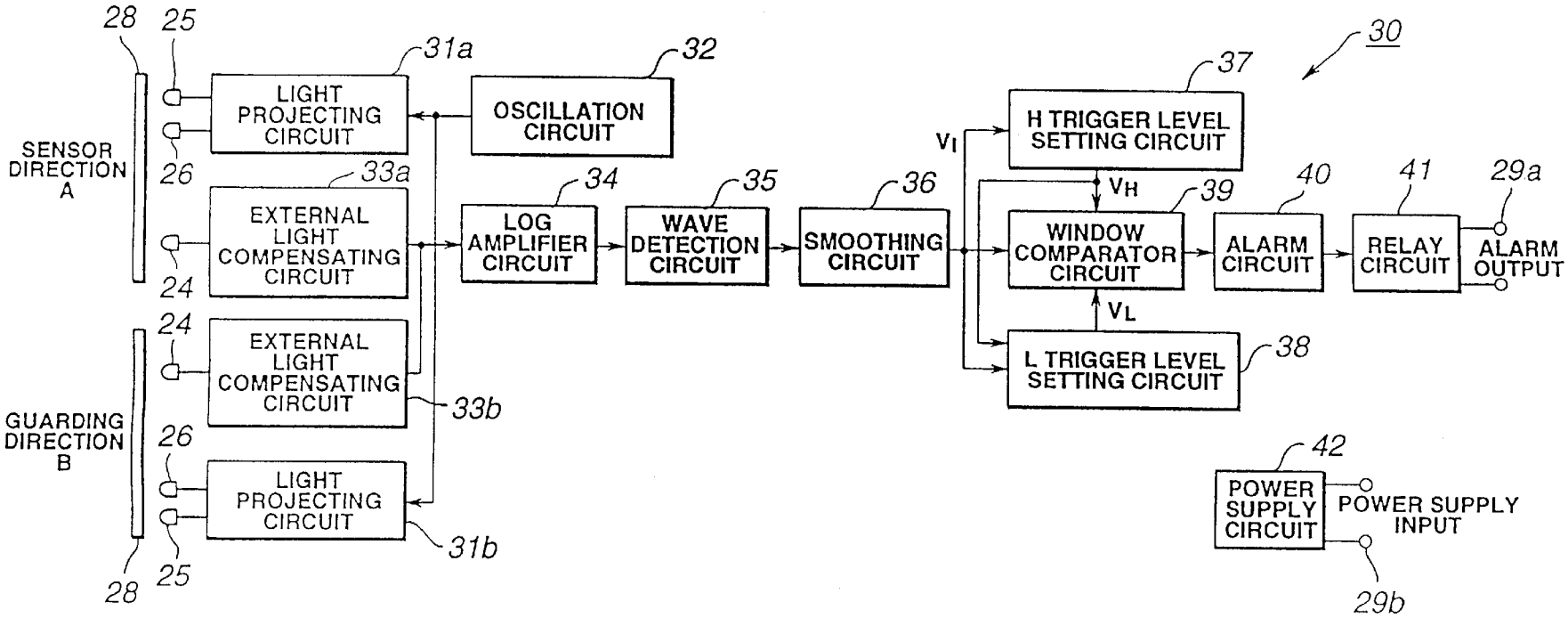
FIG. 6 is a block diagram depicting an example of circuit configuration of the obstacle detection sensor in FIG. 3.

On the board 22, a detection circuit 30, shown in FIG. 6, has been created.

In FIG. 6, the detection circuit 30 which uses a photodiode phototransistor, or the like, as the light receiving element 24 for the above mentioned two detection areas A and B, and uses an infrared LED as the light emitting elements 25 and 26, includes: light projecting circuits 31a and 31b for driving the light emitting elements 25 and 26 to let them emit lights; an oscillation circuit 32 which controls and generates drive pulses at a specified time and frequency for the light projecting circuits 31*a* and 31*b*; external light compensating circuits 33*a* and 33*b*, to which signals from the light receiving element 24 are input, and which are used for eliminating influence of DC light from sunlight and illumination and disturbance light that flickers with commercial power supply frequency; a log amplifier circuit 34 which prevents saturation of output signals even when signals from each external light compensating circuit 33*a* and 33*b* are large; a wave detection circuit 35 for rectifying signals from the log amplifier circuit 34; a smoothing circuit 36 for smoothing signals from the wave detection circuit 35; a window comparator circuit 39 which compares a signal from the smoothing circuit 36 with a trigger level (threshold) being set by an H trigger level setting circuit 37 and L trigger level setting circuit 36, and outputs a signal when the above signal is deviated from the range between these trigger levels; an alarm circuit 40 for sounding an alarm when the signal is output from the window comparator circuit 39; and a relay circuit 41 for notifying the signal from the alarm circuit 40 to the outside.

Each of the above circuits is driven by a power supply circuit 42 to which power is supplied from the power supply input terminal 29*b* of the terminal block 29.

The log amplifier circuit 34 has a wide dynamic range of input signals so that output of the amplifier is not saturated even when quantity of reflected light in the detection area A is high, therefore changes of quantity of reflected light caused by an obstacle is detected accurately.

The H trigger level setting circuit 37 and the L trigger level setting circuit 38 automatically sets the trigger level of the window comparator circuit 39 based on the size of the output signal VI of the smoothing circuit 36.

Trigger levels in these circuits are set not to respond to rapid changes of input signals, by having a several second or longer delay time, for example.

Figure 8:
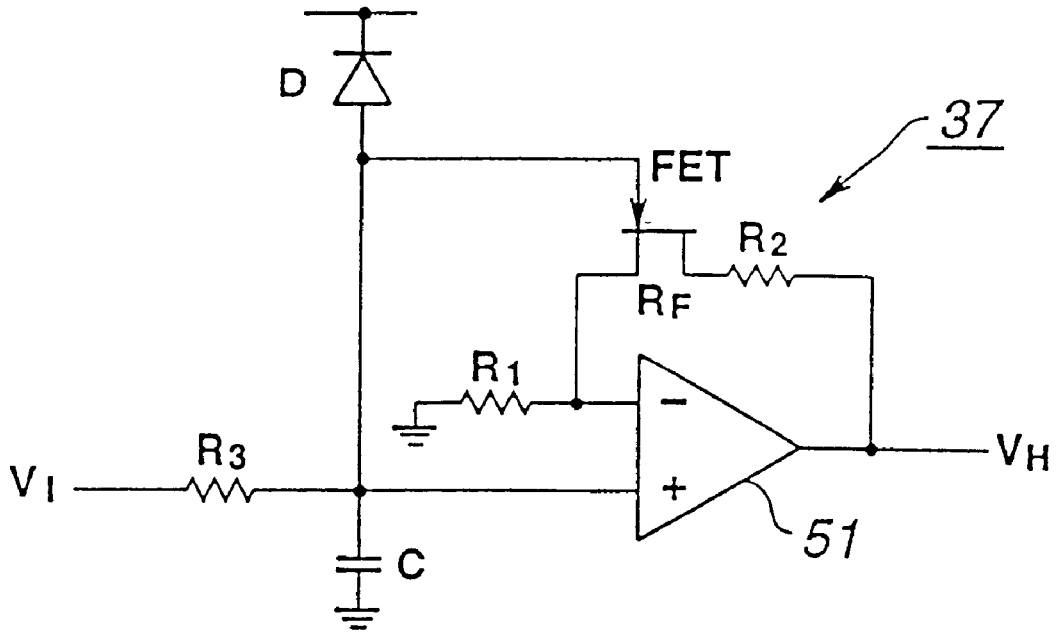
FIGS. 8(*a*) and 8(*b*) are circuit diagrams depicting concrete examples of the level setting circuits of the circuit in FIG. 6.
Figure 8:
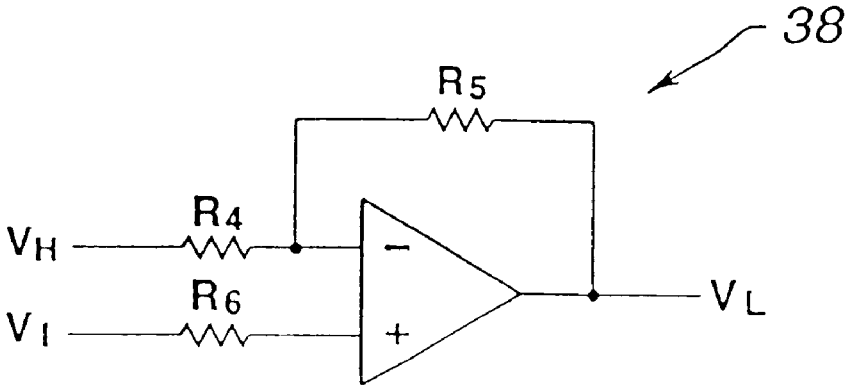

FIG. 8 shows a concrete configuration example of the H trigger level setting circuit 37 (FIG. 8(*a*)) and the trigger level setting circuit 38 (FIG. 8(*b*)).

In FIG. 8, a trigger level setting circuit 50 comprises: an operation amplifier 51, a capacitor C which is connected between a non-inversion input terminal and a ground of the operation amplifier 51; a diode D which is connected between the non-inversion input terminal and a constant voltage power supply; a resistor R1 which is connected between an inversion input terminal and a ground; and FET which is connected to the inversion input terminal and an output terminal via a resistor R2, where the gate is connected to the non-inversion input terminal, and a signal VI from the smoothing circuit 36 is input to the non-inversion input terminal via a resistor R3.

The output signal VH is designed so as to respond to the input signal VI several seconds or more later depending on the time constant of R3×C, which makes sensitivity adjustment at installing this detector unnecessary, and allows maintaining stable sensitivity constantly even if quantity of receiving light of the detector changes due to deterioration.

The trigger level VH of the H trigger level setting circuit 37 is set by the circuit shown in FIG. 8(*a*) based on the following formula:

$$VH=\{(R1+R2+Rr)/R1\}\times VI$$

The trigger level VL of the L trigger level setting circuit 38, on the other hand, is set by the circuit shown in FIG. 8(*b*) based on the following formula, if R4=R5:

$$VL=2VI-VH$$

Figure 9:
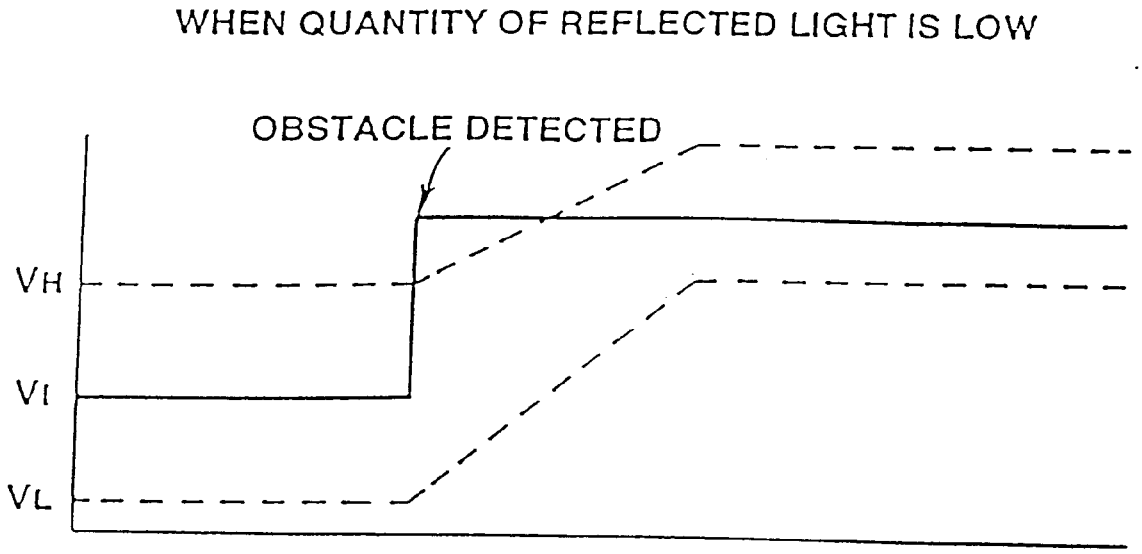
FIGS. 9(*a*) and 9(*b*) show operating waveforms in a window comparator circuit of the circuit in FIG. 6 when (a) quantity of reflected light is low and (b) quantity of reflected light is high.
Figure 9:
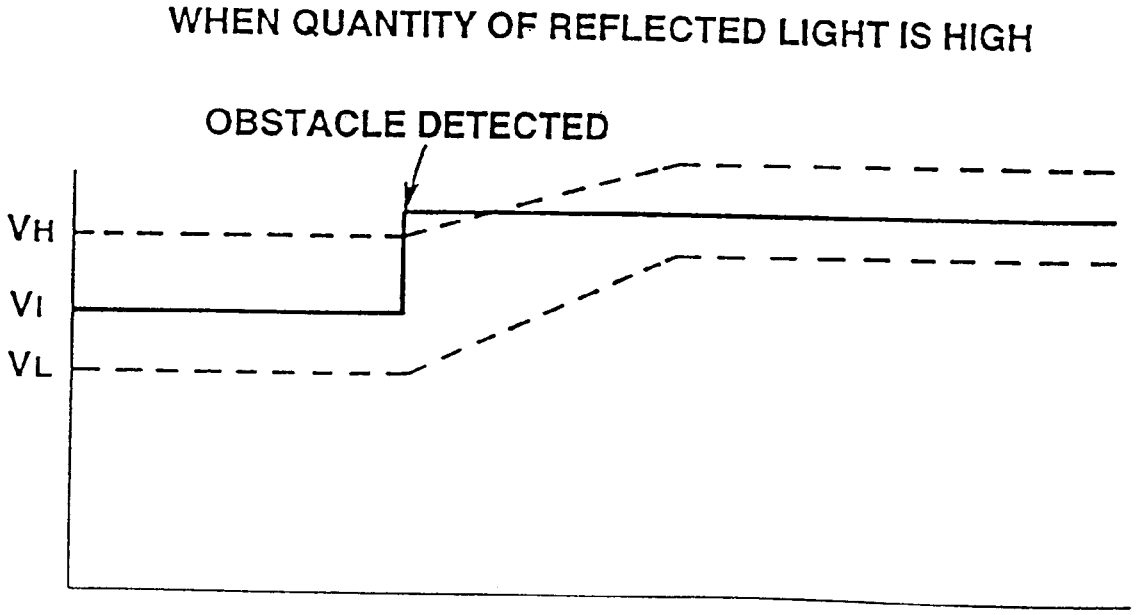
Figure 10:
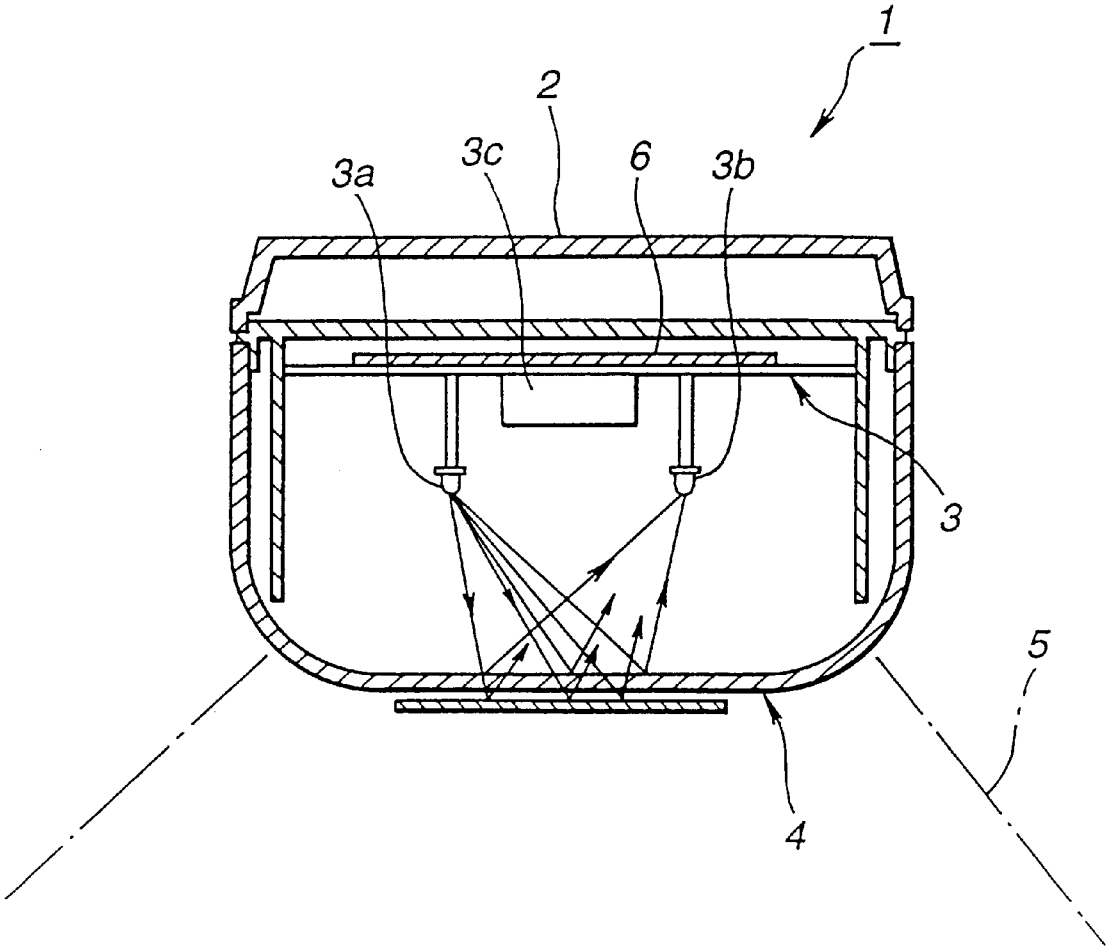
FIG. 10 is a schematic sectional view depicting an example of a conventional detector.

With such a configuration, the window comparator circuit 39 operates as shown in the operating waveform in FIG. 9. When quantity of reflected light is low, the input signal VI is small and the two trigger level setting circuits 37 and 38 set the trigger level to be wide, as shown in FIG. 9(*a*). Whereas when quantity of reflected light is high, the input signal VI is large and the two trigger level setting circuits 37 and 38 set the trigger level to be narrow, as shown in FIG. 9(*b*). Thus the obstacle detection sensitivity can always be constant.

Said alarm circuit 40 is configured so as to output an obstacle detection signal, that is, an alarm signal, to the outside, and to stop outputting alarm for a specified time after power ON, to select whether alarm is output only once or continuously, and to include a reset switch of the alarm and a pilot light of the alarm if necessary.

The detector 10 of the present embodiment is configured as in the above description, and if a trespasser is not in the detection field, then a signal is not output from the pyroelectric element of the sensor section 12 because quantity of the far infrared energy from the detection field 14 is unchanged.

If a trespasser enters the detection field 14 in this status, quantity of the far infrared energy received by the pyroelectric element of the sensor section 12 changes. The change of quantity of the infrared energy is processed appropriately by a processing circuit, not illustrated, created in the sensor section 12, and existence of the trespasser is detected.

The obstacle detection sensor 20, on the other hand, is operated as follows.

Figures 7A, 7B, 7C, 7D, 7E, 7F:
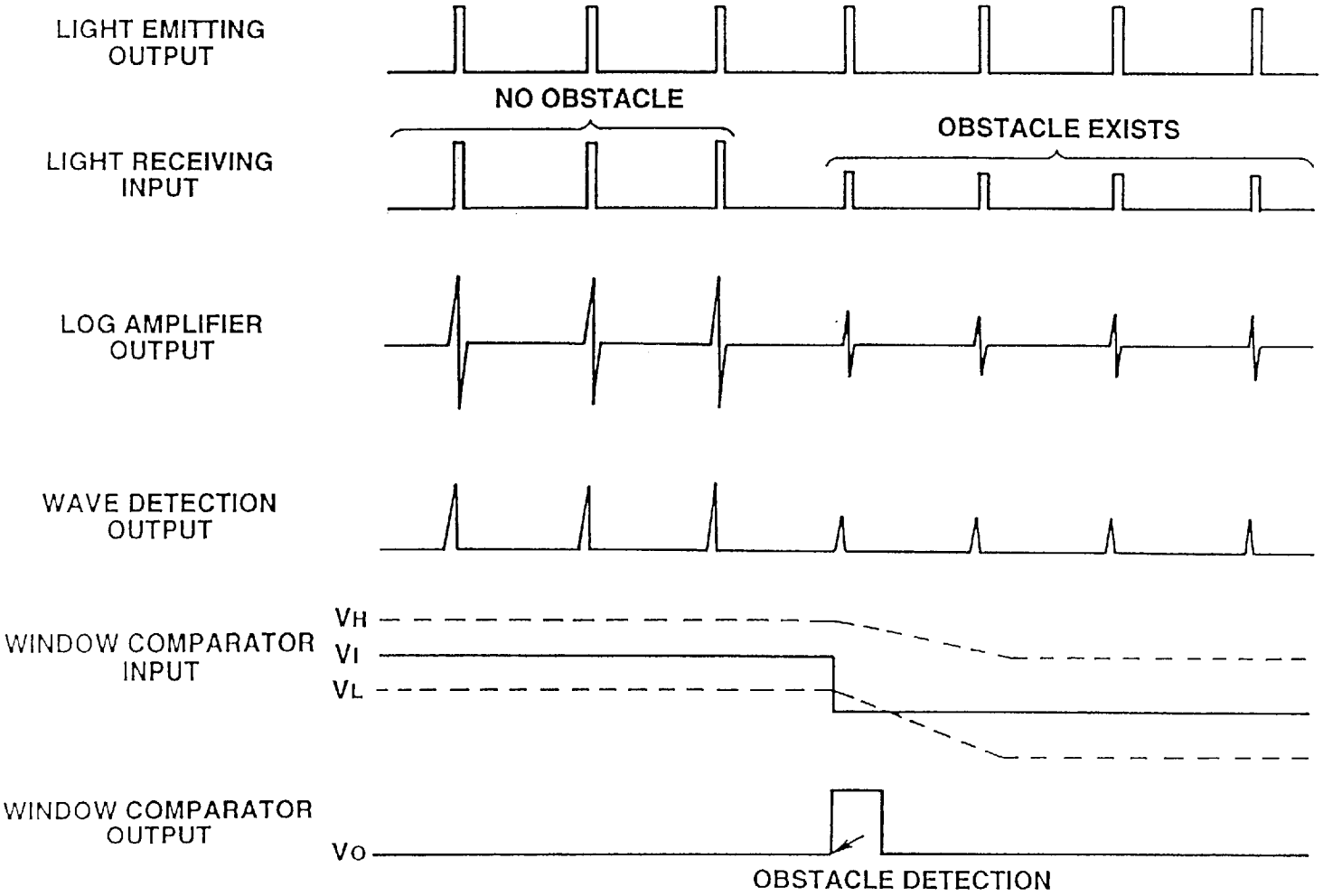
FIGS. 7(A)–7(F) are time charts depicting signals of each part of the circuit in FIG. 6.

The light emitting elements 25 and 26 are pulse-driven by the oscillation circuit 32, and emit pulse-driven light at a specified interval, as shown in FIG. 7(A). The lights emitted from the light emitting elements 25 and 26 are irradiated to the detection area A for obstacle detection, located on and around the surface of the cover 13 of the detector, and reflected lights from this area enter the light receiving element 24 and are detected.

For example, when an obstacle for disabling the detection function of the detector 10 exists, such as covering the cover 13, attaching a tape to the surface of the cover 13, and coating or spraying paint on the surface of the cover 13, quantity of received light decreases in some cases, and increases in others.

Here, quantity of light received by the light receiving element 24 becomes relatively high when an obstacle does not exist, and becomes low when an obstacle exists, as shown in FIG. 7(B).

The detection signal of the light receiving element 24 is input to the log amplifier circuit 34 via the external light compensating circuits 33*a* and 33*b*. Here the log amplifier circuit 34 has a wide dynamic range of input signals so that output signals are not saturated.

Because of this, output signals of the log amplifier circuit 34 become relatively high when an obstacle does not exist and become low when an obstacle exists, as shown in FIG. 7(C). Then output signals from the log amplifier circuit 34 are rectified by the wave detection circuit 35, as shown in FIG. 7(D), further smoothed by the smoothing circuit 36, becoming the DC output signal VI.

In this case the output signal VI becomes relatively high when an obstacle does not exist, and low when an obstacle exists.

The output signal VI is compared with the trigger levels VH and VL, which have been set by the H trigger level setting circuit 37 and the L trigger level setting circuit 38, in the window comparator circuit 39, and the detection signal is output from the window comparator circuit when the output signal VI is outside the range between these two trigger levels.

If an obstacle exists in this case, the output signal VI becomes smaller, as shown in FIG. 7(E), whereas the trigger levels VH and VL being set by the H trigger level setting circuit 37 and the L trigger level setting circuit 38 respond several seconds later depending on the time constant by the resistor R3 and C, as described above, therefore the output signal VI temporarily deviates from the range of the trigger levels.

The obstacle is detected by this, as shown in FIG. 7(F) and the window comparator circuit 39 outputs the detection signal.

Thus the alarm circuit 40 outputs an alarm signal based on the detection signal from the window comparator circuit 39, and outputs the alarm signal from the alarm output terminal 29*a* of the terminal block 29 to the outside via the relay circuit 41.

In the above description, a case when quantity of incident light to the light receiving element 24 of the obstacle detection sensor 20 decreases because of the existence of an obstacle was described, however, in the case when quantity of incident light to the light receiving element 24 increases because of the existence of an obstacle, output of the detection signal from the light receiving element 24 corresponding to quantity of incident light to the light receiving element 24 increases the level of the output signal VI from the smoothing circuit 36, and exceeds the H trigger level VH in the window comparator circuit 39, which outputs the alarm signal and detects the obstacle in the same way.

In the detection area B for detecting a trespasser or the like, if such an obstacle as a hanging screen and a poster that blocks the detection field 14 of the detector 10 exists, the object is detected in the same way.

Here the obstacle detection sensor 20 is configured so as to be equipped around the outside of the cover 13 of a conventional detector 10, therefore it is unnecessary to modify or to readjust this detector currently in use, and the obstacle detection sensor can easily be integrated merely by adding the obstacle detection sensor 20 around the detector.

In the preferred embodiment described above, the obstacle detection sensor 20 is an infrared reflection type sensor, but this is not restrictive, and it is apparent that another detection sensor, such as a position sensitive device (PSD) and ultrasonic sensor, can be used.

Also in the preferred embodiment described above, the board case 18 is a visible light cutting filter, but this is not restrictive, and the cover 23 can be the visible light cutting filter with omitting the board case 18.

Also in the preferred embodiment described above, the sensor section 12 is an infrared passive sensor which receives infrared radiation from the outside, but this is not restrictive, and it is apparent that the sensor can be a reflection type infrared active sensor that has an infrared light emitting element and an infrared light receiving element, or an ultrasonic or microwave doppler detection sensor.

Also in the preferred embodiment described above, the base 11 and 21 are mounted on a ceiling, for example, but this is not restrictive, and it is apparent that they can be mounted on a vertical or inclined wall.

Figure 11:
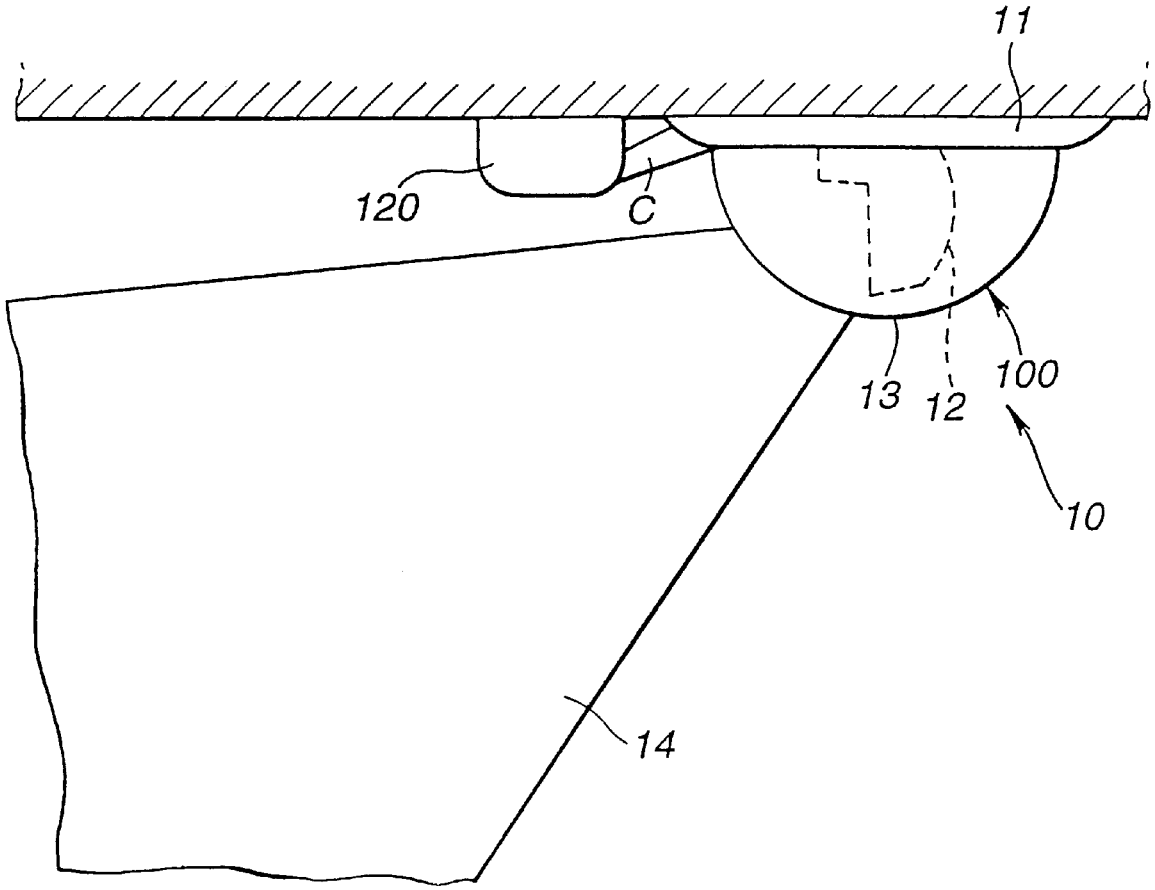
FIG. 11 is a schematic side view depicting a detector of another preferred embodiment of the present invention.

Also in the preferred embodiment described above, an obstacle is detected in the detection areas A and B, but this is not restrictive, and the obstacle detection sensor 120 for detecting changes of reflectance of the base 11, for example, can be used for the present invention, as shown in FIG. 11. The obstacle detection sensor 120 has a detection area C for detecting reflectance of the surface of the base 11 of the detector 10. This obstacle detection sensor 120 can be made from materials and components similar to a series of material and components used for detecting an obstacle by measuring reflectance of the cover 13.

In the case of using the obstacle detection sensor 120, the above described effects can be achieved by such a method as improving the surface of the base 11 so as to scatter lights more easily, changing the angle of the reflecting surface of the base 11, and attaching a retroreflection tape.

In the preferred embodiment described above, the obstacle detection sensor 20 is configured so as to be a separate unit from the detector main unit 100, which makes it possible to mount the obstacle detection sensor of the present invention to a detector which has already been installed. This configuration also makes it possible to install a spacer or the like, between the detector main unit and the obstacle detection sensor, which allows setting a detection field more freely compared with the case where the detector main unit and the obstacle detection sensor are integrated. It is also easy to make a detection field of the obstacle detection sensor to be variable.

In the preferred embodiment described above, the obstacle detection sensor 20 is configured so as to be a separate unit from the detector main unit 100, but this is not restrictive, and it is apparent that the obstacle detection sensor 20 can be integrated with the detector main unit 100.

As described above, in the present invention, where the obstacle detection sensor for detecting a change of reflectance on and around the surface of the cover, if an attempt is made for disabling the detection field of the detector intentionally, such as putting an interfering cover on the cover, attaching a tape to the external surface of the cover, and coating or spraying paint, then the obstacle detection sensor detects the obstacle by detecting a change of reflectance caused by the interfering cover, tape or paint, or by detecting a human hand handling the interfering cover, tape or paint.

Also in the present invention, the obstacle detection sensor for detecting a change of reflectance on and around the surface of the base can be installed. In this configuration, the obstacle detection sensor can easily detect an obstacle without influencing detection sensitivity of the detector.

As a consequence, the detector can constantly detect a trespasser or the like without being blocked by the interfering cover.

Thus the present invention provides an extremely superb detector which detects an obstacle in the detection field with a simple configuration and at low cost.

What is claimed is:

1. A detector comprising:

a base to be mounted on a ceiling, a wall or the like;

a sensor section mounted on the surface of the base;

a cover mounted on the base so as to cover the sensor section; and an obstacle detection sensor provided outside said cover and separate from said base for detecting a change of reflectance on and around the surface of said cover.

2. The detector according to claim 1, wherein said obstacle detection sensor further comprises a light emitting element for emitting light to locations on and around the surface of said cover; and a light receiving element for receiving reflected light from these locations.

3. The detector according to claim 1, wherein said obstacle detection sensor further comprises a first light emitting element, a second light emitting element and a light receiving element, which are arranged in the sequence of said first light emitting element, said light receiving element and said second light emitting element.

4. The detector according to claim 1, wherein said obstacle detection sensor includes a particular detection area that intersects the detection area of the sensor section.

5. The detector according to claim 1, wherein said obstacle detection sensor is configured so as to be a separate unit which is detachable from said detector.

6. The detector according to claim 1, wherein said obstacle detection sensor further comprises a light emitting unit; a light receiving unit which receives light emitted from said light emitting unit and outputs an output signal based on the quantity of the received light; a first threshold output circuit for outputting the first threshold based on said output signal from said light receiving unit; a second threshold output circuit for outputting the second threshold based on said output signal from said light receiving unit; and a comparison circuit for outputting a specified signal based on the output signals from said first threshold output circuit and said second threshold output circuit.

7. A detector comprising:

a base to be mounted on a ceiling, a wall or the like;

a sensor section mounted on the surface of the base;

a cover mounted on the base so as to cover the sensor section; and an obstacle detection sensor provided outside said cover and separate from said base for detecting a change of reflectance on and around the surface of said base.

8. The detector according to claim 7, wherein said obstacle detection sensor is configured so as to be a separate unit which is detachable from said detector.

9. A detector comprising:

a base to be mounted on a ceiling, a wall or the like;

a sensor section mounted on the surface of the base;

a cover mounted on the base so as to cover the sensor section; and an obstacle detection sensor provided outside said cover for detecting a change of reflectance on and around the surface of said cover;

wherein said obstacle detection sensor comprises a light emitting unit; a light receiving unit which receives light emitted from said light emitting unit and outputs a signal based on the quantity of the received light; a first threshold output circuit for outputting a first threshold based on the output signal from said light receiving unit; a second threshold output circuit for outputting a second threshold based on said output signal; and a comparison circuit for outputting a specified signal based on the output signals from said first and second threshold output circuits;

wherein said first and second threshold output circuits automatically set the threshold levels based on the output signal from said light receiving unit, and output the setting to said comparison circuit.

10. The detector according to claim 9, wherein said threshold levels are set when a specified delay time has passed after the output signal from said light receiving unit.

* * * * *